US006175709B1

(12) United States Patent
Takagi et al.

(10) Patent No.: US 6,175,709 B1
(45) Date of Patent: Jan. 16, 2001

(54) TONER SUPPORT AND IMAGE FORMING APPARATUS

(75) Inventors: Koji Takagi, Kawasaki; Tokuo Okada; Toshiaki Arai, both of Tokyo; Takahiro Kawagoe, Tokorozawa; Takashi Kitamura, Musashimurayama, all of (JP)

(73) Assignee: Bridgestone Corporation, Tokyo (JP)

( * ) Notice: Under 35 U.S.C. 154(b), the term of this patent shall be extended for 0 days.

(21) Appl. No.: 09/516,952

(22) Filed: Mar. 1, 2000

(30) Foreign Application Priority Data

Jan. 14, 1999 (JP) ..... 11-8425
Jan. 14, 1999 (JP) ..... 11-8426

(51) Int. Cl.[7] ..... G03G 15/08
(52) U.S. Cl. ..... 399/279; 399/265; 399/285
(58) Field of Search ..... 399/53, 55, 119, 399/265, 270, 271, 279, 281, 282, 285, 286; 430/56, 59, 83, 120, 122

(56) References Cited

U.S. PATENT DOCUMENTS 5,324,884 * 6/1994 Honda et al. ..... 118/651
5,587,224 * 12/1996 Hsieh et al. ..... 428/195
6,029,034 * 2/2000 Itsukushima et al. ..... 399/159
6,035,171 * 3/2000 Takaya et al. ..... 399/281

* cited by examiner

*Primary Examiner*—Arthur T. Grimley
*Assistant Examiner*—Hoang Ngo
(74) *Attorney, Agent, or Firm*—Sughrue, Mion, Zinn, Macpeak & Seas, PLLC

(57) ABSTRACT

Disclosed is a toner support for preventing occurrence of an image failure such as stain, uneven image density, and fogging on a white image as much as possible, thereby certainly forming a high quality image enough to keep up with formation of a color image. The toner support is characterized in that the maximum value of a surface potential of the toner support, which is measured after an elapse of 0.35 sec since the surface of the toner support is charged by generating a corona discharge by means of applying a voltage of 8 kV to a corona discharger disposed apart from the surface of the toner support by 1 mm, is in a range of 90 V or less, and that the absolute value of a surface potential decay rate of the toner support, which is measured at an elapse of 0.2 sec after charges are imparted on the surface of the toner support by generating a corona discharge by means of applying a voltage of 8 kV to a corona discharger disposed apart from the surface of the toner support by 1 mm, is in a range of 0.1 V/sec or more.

11 Claims, 3 Drawing Sheets

TONER SUPPORT AND IMAGE FORMING APPARATUS

BACKGROUND OF THE INVENTION

1. Field of the Invention

The present invention relates to a toner support suitably used as a developing roller which is provided, in an electrophotographic apparatus or electrostatic recording apparatus such as a copying machine or printer, for visualizing an electrostatic latent image by using a non-magnetic one-component developer, and an image forming apparatus such as a developing apparatus including the toner support. In particular, the present invention relates to a toner support for preventing occurrence of fogging on a white image, thereby forming a high quality image without occurrence of a change in image with time and uneven image even upon continuous printing or partial printing of a sold image, and an image forming apparatus including the toner support.

2. Prior Art

According to a prior art printing process using an electrophotographic image forming apparatus such as a copying machine or printer, development has been performed by supplying a non-magnetic one-component developer to a photosensitive drum on which a latent image is retained, to allow the developer to adhere on the latent image formed on the photosensitive drum, thereby visualizing the latent image. As such a developing method, a press-developing method has been known, for example, from U.S. Pat. Nos. 3,152,012 and 3,731,146. According to this method, since the developer does not require a magnetic material as a carrier, it is easy to simplify and miniaturize the apparatus and since the developer does not contain a magnetic powder, it is possible to keep up with formation of a color image.

In this press-developing method, development is performed by bringing a developing roller (toner support), on which a toner (non-magnetic one-component developer) is supported, into contact with a latent image retainer (image forming body) such as a photosensitive drum, on which an electrostatic latent image is retained, to allow the toner to adhere on the latent image formed on the latent image retainer, and accordingly, the developing roller is required to be formed of a conductive elastic body.

The press-developing method will be more concretely described with reference to FIG. 4. Referring to this figure, a developing roller (toner support) 1 is disposed between a toner-coating roller 4 for supplying a toner 6 and a photosensitive drum (image forming body) 5 for retaining an electrostatic latent image. The toner 6 is supplied from the toner-coating layer 4 to the surface of the developing roller 1 by rotating the developing roller 1, photosensitive drum 5, and toner-coating layer 4 in the direction shown by arrows in FIG. 4. The toner 6 thus supplied onto the developing roller 1 is formed into a thin layer having a uniform thickness by a layer forming blade 7. Then, by rotating the developing roller 1 in contact with the photosensitive drum 5, the toner 6 formed into the thin layer on the developing roller 1 adheres on the latent image formed on the photosensitive drum 5, to thereby visualize the latent image. In the figure, reference numeral 8 designates a transfer unit at which a toner image is transferred on a recording medium such as a paper sheet, and 9 is a cleaning unit at which the toner remaining on the surface of the photosensitive drum 5 after the transfer step is removed with a cleaning blade 10.

In the above-described developing process, the developing roller 1 must be rotated while certainly holding the state being in close contact with the photosensitive drum 5. To meet such a requirement, as shown in FIG. 1, the developing roller 1 has a structure in which a semi-conductive elastic layer 3 is formed around the outer periphery of a shaft 2 made from a metal having a good conductivity. The semi-conductive elastic layer is formed of a semi-conductive elastic body made from an elastomer such as silicone rubber, NBR, EPDM, ECO, or polyurethane to which carbon black or a metal powder is dispersed or a foamed body obtained by foaming the elastomer. In some cases, a covering layer 3*a* made from a resin or the like is formed on the surface of the semi-conductive elastic layer 3 for controlling the charging and adhesion characteristics to the toner, controlling a friction force between the developing roller and the layer forming blade, and preventing the photosensitive drum 5 from being contaminated by the elastic body forming the developing roller.

A method of forming an image by allowing a toner supported on the toner support to directly fly on a paper sheet or OHP sheet via a hole-shaped control electrode has been also proposed.

To obtain an electric field required for transferring the toner supported on the toner support to the image forming body, the resistance of the toner support is adjusted at a value of about $10^5$ to $10^9$ Ω. In many cases, to easily adjust the resistance of the toner support, the resistance of the resin-covering layer 3*a* is set at a value higher than that of the semi-conductive elastic layer 3. Like the adjustment of the resistance of the semi-conductive elastic layer 3, the adjustment of the resistance of the resin-covering layer 3*a* is often performed by adding carbon black, a metal powder, a metal oxide, and the like thereto.

To obtain a high performance, particularly, a high quality image in a printing process using an electrophotographic system including the above-described developing roller (toner support), the developer supported on the developing roller is required to be usually in a uniform charged state while keeping constant values of charges until the developer is transferred onto the image forming body.

If the electric characteristics of the developing roller vary over the entire surface of the roller, there arise the following problems. Namely, in the case of forming a high quality image or forming a color image by using an image forming apparatus such as a printer, there occur an image failure such as stain, uneven image density, and fogging on a white image. Upon continuous printing, the charged amount of the developer supported on the developing roller is often made unstable and gradually changed, with a result that the toner at a non-developed portion on the developing roller is continuously charged by friction, thereby causing an inconvenience that the charged amount exceeds a specific value. Upon partial printing of a black solid image, the charged amount of the developer newly supported on a portion at which the black solid image has been printed is different from that at the periphery thereof, with a result that there occurs an uneven image due to unevenness of the developer charging distribution. Such phenomena tend to occur under the condition that the charges imparted on the surface of the toner support are less escaped therefrom.

In this case, charges imparted on the surface of the toner support may be grounded from the surface mainly via the conductive shaft, to be thus decayed. From this viewpoint, for a developing sleeve used for development by a magnetic toner, since the metal base is very conductive, the surface charges are allowed to easily flow to a ground portion, and therefore, there is no problem associated with the residual surface charges; however, for the toner support mainly made from a semi-conductive material used for development by a non-magnetic one-component toner, since the resistance of the semi-conductive material is high, the residual charges are less escaped and thereby remain on the surface of the toner support for a long time, with a result that there arise inconveniences caused by the residual charges.

SUMMARY OF THE INVENTION

An object of the present invention is to provide a toner support for preventing an image failure such as stain, uneven image density, and fogging on a white image as much as possible, thereby certainly forming a high quality image enough to keep up with formation of a color image, without occurrence of a change in image with time and uneven image even upon continuous printing and partial printing of a solid image, and to provide an image forming apparatus including the toner support.

The present inventors have made studies to obtain a toner support capable of forming a high quality image enough to keep up with formation of a color image, and found the fact that it is possible to prevent the occurrence of an image failure such as stain, uneven image density, and fogging on a white image and hence to form a high quality image not only by controlling the electric resistance between a metal shaft and the roller surface at a specific average value and also eliminating a variation in electric resistance over the entire surface of the roller (which has been regarded important for the prior art developing roller or toner support), but also by keeping the surface charge retaining ability on the developing roller, which exerts effect on the charging characteristic of the toner, at a specific average value and also eliminating a variation in surface charge retaining ability over the entire surface of the roller; and further, the present inventors have found the fact that it is possible to equalize the toner charged amount upon continuous printing or partial image printing and hence to certainly form a high quality image by setting the residual charge retaining ability on the surface of the roller at a specific value or less.

The present inventors have further made studies on evaluation of a suitable electric resistance and a desirable surface charge retaining ability of the toner support having on its surface a resin-covering layer, and found the fact that it is possible to prevent occurrence of an image failure such as stain, uneven image density, and fogging on a white image due to residual charges as much as possible and further certainly hold a desirable image even upon continuous printing or partial image printing and hence to certainly, stably form a high quality image enough to keep up with formation of a color image, by specifying the electric resistance of the toner support (which is measured when 100 V is applied thereto under a measurement environment of 22° C. and 50% RH) in a range of $10^4$ to $10^{10}$ Ω and also controlling the maximum value of a surface potential (which is measured after an elapse of 0.35 sec since the surface of the toner support is charged by generating a corona discharge by means of applying a voltage of 8 kV to a corona discharger disposed apart from the surface of the toner support by 1 mm) in a range of 90 V or less. The following first present invention has been thus accomplished.

Accordingly, the first invention provides a toner support, which supports on its surface a non-magnetic one-component developer in the form of a thin layer, coming in contact with or in proximity to an image forming body, and supplies the developer onto the surface of the image forming body, thereby forming a visual image on the image forming body, the toner support including: a shaft having a good conductivity; and a semi-conductive elastic layer formed around the outer periphery of the shaft; wherein an electric resistance of the toner support when a voltage of 100 V is applied thereto is in a range of $10^4$ to $10^{10}$ Ω; and the maximum value of a surface potential of the toner support, which is measured after an elapse of 0.35 sec since the surface of the toner support is charged by generating a corona discharge by means of applying a voltage of 8 kV to a corona discharger disposed apart from the surface of the toner support by 1 mm, is in a range of 90 V or less. The first invention also provides an image forming apparatus including the toner support.

The present inventors have also found the fact that it is possible to prevent occurrence of uneven image density and fogging on a white image and hence to form a high quality image not only by equalizing the above-described residual charge retaining ability but also equalizing the surface resistance on the developing roller or toner support, which exerts effect on the charging characteristic of the toner, and found the fact that it is possible to equalize the charged amount of the toner even upon continuous printing or partial image printing and hence to certainly form a high quality image by setting the decay rate of the residual charges on the surface of the toner support at a specific value or more.

The present inventors have further made studies on evaluation of a suitable surface resistance and a desirable surface charge decay rate of the toner support, and found the fact that it is possible to prevent occurrence of uneven image density and fogging on a white image as much as possible and further certainly hold a desirable image even upon continuous printing or partial image printing and hence to certainly, stably form a high quality image enough to keep up with formation of a color image, by controlling the absolute value of a surface potential decay rate (which is measured at an elapse of 0.2 sec after charges are imparted on the surface of the toner support by generating a corona discharge by means of applying a voltage of 8 kV to a corona discharger disposed apart from the surface of the toner support by 1 mm) in a range of 0.1 V/sec or more Accordingly, the second invention provides a toner support, which supports on its surface a non-magnetic one-component developer in the form of a thin layer, coming in contact with or in proximity to an image forming body, and supplies the developer onto the surface of the image forming body, thereby forming a visual image on the image forming body, the toner support including: a shaft having a good conductivity; and a semi-conductive elastic layer formed around the outer periphery of the shaft; wherein the absolute value of a surface potential decay rate of the toner support, which is measured at an elapse of 0.2 sec after charges are imparted on the surface of the toner support by generating a corona discharge by means of applying a voltage of 8 kV to a corona discharger disposed apart from the surface of the toner support by 1 mm, is in a range of 0.1 V/sec or more. The second invention also provides an image forming apparatus including the toner support.

DETAILED DESCRIPTION OF THE INVENTION

Figure 1:
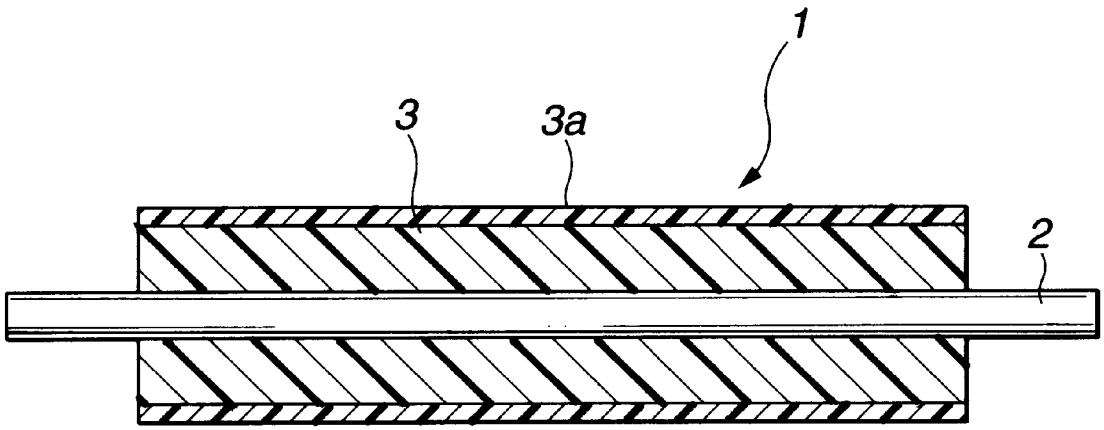
FIG. 1 is a schematic sectional view showing one example of a toner support of the present invention.

The toner supports according to the above-described first and second inventions are each typically configured as a roller 1 shown in FIG. 1. The roller 1 includes a shaft 2 having a good conductivity and a semi-conductive elastic layer 3 formed around the outer peripheral of the shaft 2. A semi-conductive resin-covering layer 3*a* is further formed around the semi-conductive elastic layer 3 as needed.

The shaft 2 is not particularly restrictive insofar as it has a good conductivity; however, it is usually formed of a sold core or a hollow cylinder made from a metal material such as ordinary steel, stainless steel, or aluminum.

The semi-conductive elastic layer 3 formed around the outer periphery of the shaft 2 is formed of a semi-conductive elastic body such as an elastomer or a foam body obtained by foaming the elastomer to which an electronic conductive agent such as carbon black or an ionic conductive agent such as sodium perchlorate is added for controlling the resistivity of the semi-conductive elastic body.

Specific examples of the above-described elastomers include silicone rubber, EPDM, NBR, natural rubber, SBR, butyl rubber, chloroprene, acrylic rubber, epichlorohydrin rubber, EVA, polyurethane, and mixtures thereof. In particular, silicone rubber, EPDM, epichlorohydrin rubber, and polyurethane are preferably used as the elastomers. The elastomer may be used as a foamed body obtained by chemically foaming the elastomer with a foaming agent, or obtained by foaming the elastomer typically polyurethane by means of mechanically entraining air in the elastomer.

Specific examples of the electronic conductive agents to be added to the semi-conductive elastic layer 3 include a conductive carbon material such as ketchen black or acetylene black; a carbon material usually used as an additive for rubber, such as SAF, ISAF, HAF, FEF, GPF, SRF, FT or MT; an oxidized carbon material usually used as a coloring agent for ink; pyrolytic carbon; natural graphite; artificial graphite; antimony doped tin oxide, titanium oxide, or zinc oxide; a metal such as nickel, copper, silver, or germanium, or a metal oxide thereof; and a conductive polymer such as polyaniline, polypyrrole, or polyacetylene. The added amount of the electronic conductive agent is usually in a range of 1 to 50 parts by weight, preferably, 5 to 40 parts by weight on the basis of 100 parts by weight of the above elastomer.

Specific examples of the ionic conductive agents to be added to the semi-conductive elastic layer 3 include ammonium salts, for example, a perchlorate, chlorate, hydrochloride, bromate, iodate, hydroborofluoride, sulfate, ethylsulfate, carboxylate, and sulfonate of tetraethyl ammonium, tetrabutyl ammonium, dodecyltrimethyl ammonium, hexadecyltrimethyl ammonium, benzyltrimethyl ammonium, and denatured fatty acid dimethylethyl ammonium; and metal salts, for example, a perchlorate, chlorate, hydrochloride, bromate, iodate, hydroborofluoride, and sulfate of an alkali metal such as lithium, sodium or potassium, and an alkali earth metal such as calcium or magnesium. The added amount of the ionic conductive agent is usually in a range of 0.01 to 5 parts by weight, preferably, 0.05 to 2 parts by weight on the basis of the 100 parts by weight of the above elastomer.

The above conductive agents may be added singly or in combination of two kinds or more. In this case, the electronic conductive agent and ionic conductive agent may be combined with each other.

The electric resistance of the semi-conductive elastic layer 3 is not particularly restrictive; however, it may be set in a range of $10^3$ to $10^{10}$ Ω, preferably, $10^4$ to $10^8$ Ω by adding the above conductive agent. If the electric resistance is less than $10^3$ Ω, charges may be leaked to a photosensitive drum and the like or the toner support itself may be broken due to the voltage applied thereto; while if it is more than $10^{10}$ Ω, fogging on the ground easily occurs.

A crosslinking agent or a vulcanizing agent can be added as needed to the semi-conductive elastic layer 3 for converting the elastomer into a rubber material. In the case of either organic peroxide crosslinking or sulfur crosslinking, a vulcanization assistant, vulcanization accelerator, vulcanization activator, and vulcanization retarder may be used. In addition to the above additives, a peptizer, foaming agent, plasticizer, softener, tackifier, antitack agent, separating agent, mold release, filler, and coloring agent, which are generally used as additives for rubber, may be added to the semi-conductive elastic layer 3.

In the case where the semi-conductive elastic layer 3 is made from polyurethane or EPDM, a charge control agent such as Nigrosine, triaminophenylmethane, or cation dye; and a fine powder of silicone resin, silicone rubber, or nylon can be added to the polyurethane or EPDM for controlling the charged amount of toner on the surface of a developing roller using the semi-conductive elastic layer 3. The added amount of the charge control agent is preferably in a range of 1 to 5 parts by weight on the basis of the 100 parts by weight of polyurethane or EPDM, and the added amount of the fine powder is preferably in a range of 1 to 10 parts by weight on the basis of the 100 parts by weight of polyurethane or EPDM.

The hardness of the semi-conductive elastic layer 3 is not particularly restrictive; however, it may be set in a range of 60 or less, preferably, 25 to 55 in JIS A-Scale. In the case of using the semi-conductive elastic layer 3 for a developing roller, if the hardness is more than 60, the contact area of the roller with a photosensitive drum becomes small, which obstructs desirable development, and further, the toner may be damaged by the roller and fixed to the photosensitive body or a layer forming blade, to thereby easily cause an image failure. If the hardness is excessively low, a friction force between the roller and the photosensitive body or layer-forming blade becomes large, resulting in an image failure such as jitter. Further, since the semi-conductive elastic layer 3 is used in the state being in contact with the photosensitive body or layer forming blade, even if the hardness of the semi-conductive elastic layer 3 is low, a compression set thereof is preferably made as small as possible, more concretely, specified in a range of 20% or less.

The surface roughness of the semi-conductive elastic layer 3 is not particularly restrictive; however, it may be in a range of 15 μmRz or less, preferably, 1 to 10 μmRz in JIS 10-Point Average Roughness. If the surface roughness is more than 15 μmRz, it often fails to ensure a desired layer thickness of a one-component developer (toner) and the desired uniformity in charging of the toner. On the contrary, by specifying the surface roughness in the range of 15 μmRz or less, it is possible to improve the adhesive strength of the toner, and also to certainly prevent the degradation of an image due to wear of the roller caused by long-term use thereof.

As shown in FIG. 1, the semi-conductive or insulating resin-covering layer 3*a* can be formed on the semi-conductive elastic layer 3 of the toner support of the present invention for adjusting the electric resistance and controlling the charged amount and carried amount of the toner. The resin for forming the resin-covering layer 3*a* is not particularly restrictive insofar as it is not contaminative and adhesive against an image forming body such as a photosensitive drum. Specific examples of the resins include polyester resin, polyether resin, fluororesin, epoxy resin, amino resin, polyamide resin, acrylic resin, acrylic urethane resin, urethane resin, alkyd resin, phenol resin, melamine resin, urea resin, silicone resin, and polyvinyl butyral resin. These resins may be used singly or in combination of two kinds or more. A modified resin obtained by introducing a specific function group to the above resin may be used.

A conductive agent may be added to the resin-covering layer 3*a* for controlling the conductivity thereof. The conductive agent may be the same as that used for the semi-conductive elastic layer 3. Further, the resin for forming the resin-covering layer 3*a* may be desirable to have a crosslinking structure for improving the dynamic strength and environment resistance. In this case, depending on the molecular structure of the resin for forming the resin-covering layer 3*a*, there may be adopted a method of self-crosslinking the resin by applying heat, catalyst, air (oxygen), moisture (water), or ultraviolet rays thereto, or allowing the resin to react with a crosslinking agent or another crosslinking resin.

In addition to the above additives, various other additives of suitable amounts may be added to the resin-covering layer 3*a*.

The resin-covering layer 3*a* is preferably formed on the semi-conductive elastic layer 3 by surface-treating the semi-conductive elastic layer 3 with a resin solution containing the resin components and additives. The surface treatment may be performed by coating the surface of the semi-conductive elastic layer 3 with the resin solution by a spraying method, a roll-coater method, or a dipping method. The solvent used for preparing the resin solution is not particularly restrictive insofar as it can dissolve the resin. In general, however, a lower alcohol such as methanol, ethanol or isopropanol, a ketone such as acetone, methylethylketone or cyclohexane, toluene, and xylene are preferably used as the solvents.

The thickness of the resin-covering layer 3*a* is not particularly restrictive; however, it may be generally in a range of 3 to 50 μm, preferably, 5 to 30 μm. If the thickness is less than 3 μm, it often fails to sufficiently ensure the charging performance of the surface layer due to friction caused during use. If the thickness is more than 50 μm, the surface of the toner support becomes hard to damage the toner, and thereby the toner may be fixed to an image forming body such as photosensitive body or layer forming blade, thereby causing an image failure.

The resin-covering layer may be either semi-conductive or insulating; however, in general, it is preferably formed of a semi-conductive film having a volume resistivity ranging from $10^3$ to $10^{12}$ Ωcm, preferably, $10^4$ to $10^{10}$ Ωcm. In particular, to adjust the electric resistance of the roller in a specific range to be described later, it is effective to adjust the volume resistivity of the resin-covering layer 3*a* in the above range.

The present invention is characterized by optimizing the charging characteristics of the toner support. To be more specific, the toner support of the first invention is characterized by optimizing the electric resistance and the surface potential after corona charging, and the toner support of the second invention is characterized by optimizing the surface potential decay rate after corona charging. Hereinafter, the first and second inventions will be described in detail.

Toner Support of the First Invention

The toner support of the first invention is configured such that the electric resistance of the toner support when a voltage of 100 V is applied thereto is in a range of $10^4$ to $10^{10}$ Ω, preferably, $10^5$ to $10^9$ Ω. If the electric resistance is less than $10^4$ Ω, the control of gradation becomes significantly difficult, and in the case where defects are present in an image forming body such as a photosensitive body, there may occur a bias leakage. On the contrary, if the electric resistance is more than $10^{10}$ Ω, when the toner is developed on a latent image retainer such as a photosensitive body, a bias voltage is dropped by the effect of the high electric resistance of the toner support itself, so that a development bias required for development cannot be ensured and thereby a sufficient image density cannot be obtained. Additionally, the electric resistance is measured by a method wherein the toner support is pressed to a flat or cylindrical counter electrode with a specific pressure; a voltage of 100 V is applied between a shaft of the toner support and the counter electrode; and the electric resistance is calculated on the basis of a value of the current flowing therebetween.

The suitable, uniform control of the electric resistance of the toner support is important for suitably, uniformly keeping the strength of an electric field required to move the toner; however, such a control of the electric resistance is the necessary condition but the sufficient condition for suitably, uniformly keeping the charged amount of the toner on the toner support. To be more specific, as a result of the examination by the present inventors, it has been revealed that, in addition to the above control of the electric resistance, the suitable, uniform control of the charge retention ability on the surface of the toner support is important for suitably, uniformly keeping the charged amount of the toner. Here, the evaluation of the surface retention ability according to the present invention will be described. In general, the surface charge retention ability is examined by arranging a pair of electrodes on the surface of the toner support, and measuring a surface resistance while applying a specific voltage between both the electrodes; however, according to this method, since the current flows not only on the surface of the toner support but also in the toner support, it is impossible to accurate evaluate the surface charge retention ability of the toner support. Further, a four-terminal method intended to improve the accuracy in evaluation of the surface characteristic of the toner support has been disposed; however, since the surface layer is very thin, particularly, for a laminated type toner support, it is difficult to evaluate the characteristic inherent only to the surface by such a four-terminal method. As a result, it is impossible to accurately evaluate the surface charge retention ability on the basis of the characteristic values obtained by the above-described prior art methods.

According to the toner support of the first invention, in addition to the electric resistance measured when a voltage of 100 V is applied to the toner support, the surface charge retention ability is evaluated on the basis of the maximum value of a surface potential measured after an elapse of 0.35 sec since the surface of the toner support is charged by generating a corona discharge by means of applying a voltage of 8 kV to a corona discharger disposed apart from the surface of the toner support by 1 mm, and the maximum value is set in a range of 90 V or less, preferably, in a range of 50 V or less. If the maximum value is more than 90 V, when the toner is supplied to an image forming body, that is, removed from the surface of the toner support, the charges remain at the portions from which the toner has been removed, and thereby the charged amount of the toner which will be charged at the same portions becomes low; and further, when the toner is not supplied to the image forming body and continuously rotated, the charged amount of the toner is gradually increased, and in some cases, the electric field generated by the charging of the toner exceeds the maximum value, to cause a discharge between the toner support and the image forming body such as a photosensitive body, resulting in an image failure.

The reason why the surface potential is measured after an elapse of 0.35 sec since the surface of the toner support is charged due to generation of a corona discharge is as follows. Namely, it is difficult to measure the surface potential directly after the surface of the toner support is charged due to generation of the corona discharge, and further, since the surface potential at the initial stage is unstable, it may be undesirable to control the characteristic at the initial stage. In the actual image formation step, for example, the development step, if the toner support is formed into a roller shape, the speed of revolution thereof is usually set at 0.35 sec/revolution, and therefore, the control of the residual charges on the surface of the roller may be performed on the basis of the time required for each revolution, that is, 0.35 sec.

Figure 2:
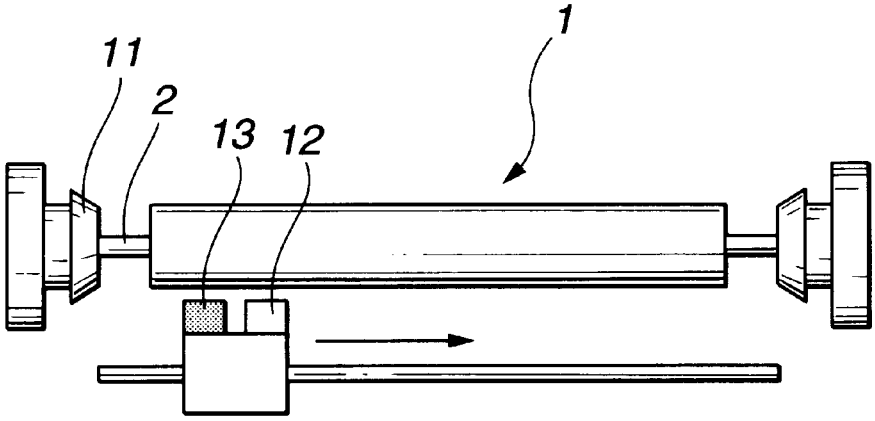
FIG. 2 is a schematic view showing one example of an apparatus for measuring a surface potential of the toner support.

The measurement of the maximum value of the above surface potential can be performed by using an apparatus shown in FIG. 2. Referring to FIG. 2, the toner support 1 is supported such that both ends of a shaft 2 thereof are held by chucks 11. A measurement unit, in which a small-sized corona discharger 12 and a surface electrometer 13 are spaced with a specific gap put therebetween, is disposed oppositely apart from the surface of the toner support 1 by 1 mm. With the toner support 1 being made immobile, the measurement unit having the corona discharger 12 and the surface electrometer 13 is moved at a specific speed from one end to the other end of the toner support 1. In this way, the surface potential after an elapse of 0.35 sec since the surface of the toner support 1 is charged by the corona discharger 12 is measured by the surface electrometer 13.

Toner Support of the Second Invention

Like the electric resistance of the toner support of the first invention, the electric resistance of the toner support of the second invention may be set in the range of $10^4$ to $10^{10}$ Ω, preferably, $10^5$ to $10^9$ Ω. In accordance with the second invention, however, the control of such an electric resistance is not necessarily essential. That is to say, the electric resistance of the toner support of the second invention may be somewhat out of the above range insofar as the toner support satisfies the requirement of the surface potential decay rate to be described later.

As described above, it is impossible to accurately evaluate the surface charge retention ability on the basis of the electric resistance. Accordingly, the toner support of the second invention is characterized in that the surface charge retention ability is evaluated on the basis of the absolute value of a surface potential decay rate, which is measured after an elapse of 0.2 sec after charges are imparted on the surface of the toner support by generating a corona discharge under a measurement environment of 22° C. and 50% RH by means of applying a voltage of 8 kV to a corona discharger disposed apart from the surface of the toner support by 1 mm, and the absolute of the surface potential decay rate is set at 0.1 V/sec or more. If the surface potential decay rate is less than 0.1 V/sec, the surface charges are gradually accumulated upon continuous operation and the charged amount of the toner on the toner support exceeds a specific value, with a result that the effective development bias exceeds the potential at a white portion of the photosensitive body upon image formation at the development step and there occurs high voltage fogging on the white printed portion; and in some cases, the electric field generated by charging of the toner exceeds the maximum value, to cause a discharge between the toner support and the image forming body such as the photosensitive body, which leads to an image failure. In addition, the polarity of the charges caused by corona discharge may be either positive or negative, and according to the present invention, it is sufficient for the absolute value of the decay rate of the surface potential caused by corona discharge to be set in a range of 0.1 V/sec or more.

Figure 6:
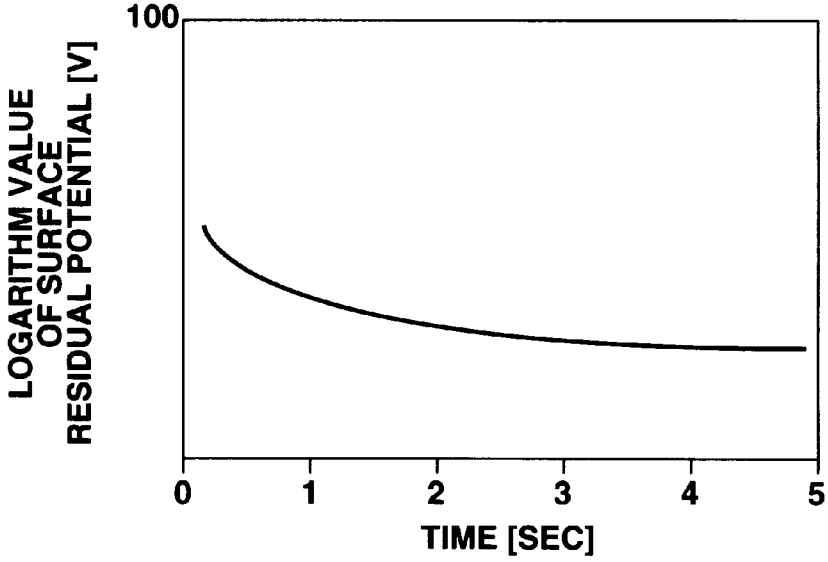
FIG. 6 is a graph showing one example of a surface charge decay curve of the toner support.

The decay of the potential on the surface of the above toner support will be briefly described. In general, the charge decay curve is expressed by a linear logarithmic plot of the surface potential V against a time t (sec), and a relaxation time (time constant) can be determined on the basis of the gradient of the straight line thus plotted. The decay curve obtained for the actual toner support, however, has no straight-line relationship as shown in FIG. 6. This is because the voltage dependency of the residual surface potential varies with time. Here, since the speed of revolution of the developing roller is generally about 0.4 sec/revolution, the charge decay rate in a period of such a short-time may be considered to be important, and further, since it takes about 0.2 sec until removal of the toner by the toner-coating layer after passing of the layer forming blade, the surface potential decay rate until an elapse of 0.2 sec after the surface is charged becomes significantly important.

Here, according to the present invention, since the non-contact type corona discharger is used as the means for imparting specific charges on the surface of the toner support, it is difficult to determine the initial charging potential at V=0. Accordingly, in the actual measurement, the decay rate (V/sec) of the surface potential in a period from a time after an elapse of 0.1 sec since the surface is charged to a time after an elapse of 0.2 sec since the surface is charged is measured and controlled. In addition, the decay rate can be calculated by taking a value of the surface potential at a time after an elapse of 0.1 sec since the surface is charged as an initial value, approximating values of the surface potential measured until an elapse of 0.2 sec since the surface is charged into a straight line by a least square approximation method, and obtaining the surface potential decay rate on the basis of the gradient of the straight-line thus approximated.

The charging of the toner support and the measurement of the surface potential can be performed by the apparatus shown in FIG. 2 in accordance with the same manner as that described in the first invention.

Figure 4:
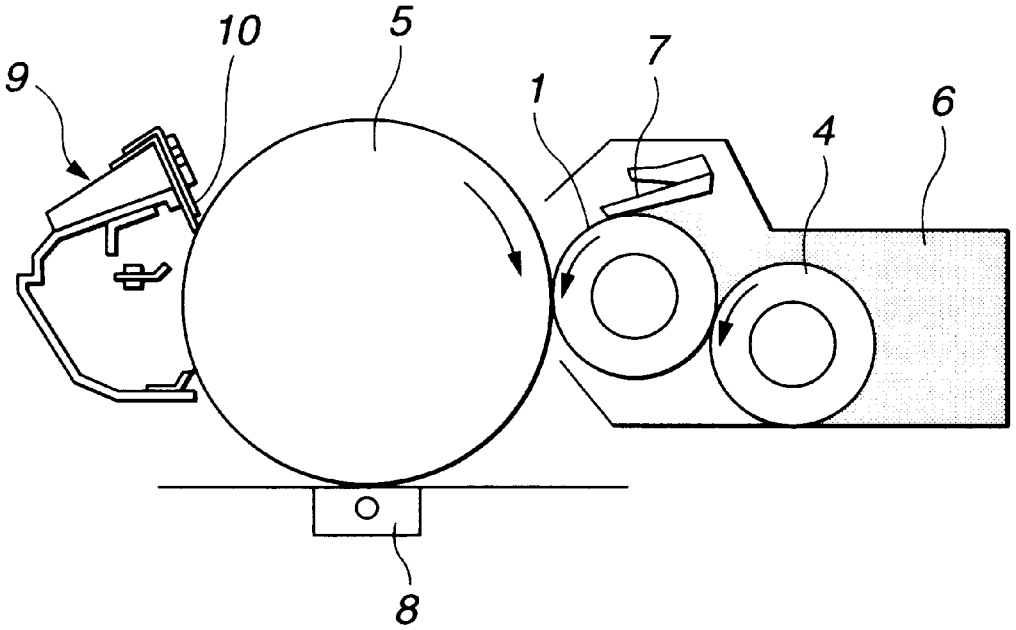
FIG. 4 is a schematic sectional view showing one example of an image forming apparatus (developing apparatus) of the present invention.

Each of the toner supports of the first and second inventions can be assembled in an image forming apparatus such as a developing apparatus using a non-magnetic one-component developer. Concretely, as shown in FIG. 4, the toner support of the present invention, which is configured as a developing roller 1, is disposed between a toner-coating layer 4 for supplying a toner 6 and a photosensitive drum 5 for retaining an electrostatic latent image in such a manner as to be in contact with or in proximity to the photosensitive drum 5. The toner 6 is supplied from the toner-coating layer 4 to the developing roller 1, being formed into a uniform thin layer by a layer forming blade 7, and is supplied to the photosensitive drum 5. The toner 6 thus supplied to the photosensitive drum 5 adheres on the electrostatic latent image, to thereby visualize the latent image. It should be noted that the developing step shown in FIG. 4 has been already described in detail in the paragraph of the prior art, and therefore, the overlapped description thereof is omitted.

Each of the toner supports of the first and second inventions can be applied not only to the above developing apparatus but also to an image forming apparatus used for forming an image by directly flying the toner supported on the toner support to an image forming body composed of a paper sheet via a hole-like control electrode.

As described above, according to the toner support of the present invention and the image forming apparatus including the toner support, it is possible to prevent occurrence of an image failure such as stain, uneven image density, and fogging on a white image as much as possible, and hence to certainly form a high quality image.

EXAMPLES

Hereinafter, the present invention will be more fully described by way of Inventive Examples and Comparative Examples. The present invention, however, is not limited to the examples.

Inventive Examples 1 to 5 and Comparative Examples 1 to 3

A polyol composition was prepared by adding 1.0 part by weight of 1,4-butanediol, 1.5 parts by weight of silicone surface active agent, 0.5 part by weight of nickel acethylacetonate, 0.01 part by weight of dibutyl tin dilaurate, and 0.01 part by weight of sodium perchlorate to 100 parts by weight of polyetherpolyol (OH value: 33, molecular weight: 5000) prepared by adding propylene oxide and ethylene oxide to glycerol, and mixing them by a mixer.

The polyol composition was stirred under a reduced pressure to be defoamed. Then, 17.5 parts by weight of urethane modified MDI was added to the defoamed polyol composition, followed by stirring for two minutes, and was poured in a mold in which a metal shaft was inserted and which was heated at 110° C. The resin poured in the mold was hardened for two hours, to form an elastic layer around the outer periphery of the metal shaft. In this way, a roller having a structure shown in FIG. 1 was obtained. The surface roughness of the roller thus obtained was adjusted, by polishing, into 7 $\mu$mRz in JIS 10-point Average Roughness.

Each of resins shown in Tables 1 and 2 and each of conductive agents shown in Tables 1 and 2 were added in methylethylketone (MEK), to prepare a paint. The above-described roller was dipped in the paint, being drawn out of the paint, and dried by heating, to form a resin-covering layer on the elastic layer of the roller. In this way, eight kinds of developing rollers (toner supports) shown in Tables 1 and 2 were obtained. In addition, the thickness of the resin-covering layer was controlled by adjusting the resin concentration of the paint. Concretely, the concentration of the paint was adjusted at 25% in Inventive Example 1; 10% in Inventive Example 2; 25% in Inventive Example 3; 25% in Inventive Example 4; 10% in Inventive Example 5; 30% in Comparative Example 1; 20% in Comparative Example 2; and 25% in Comparative example 3.

Figure 5:
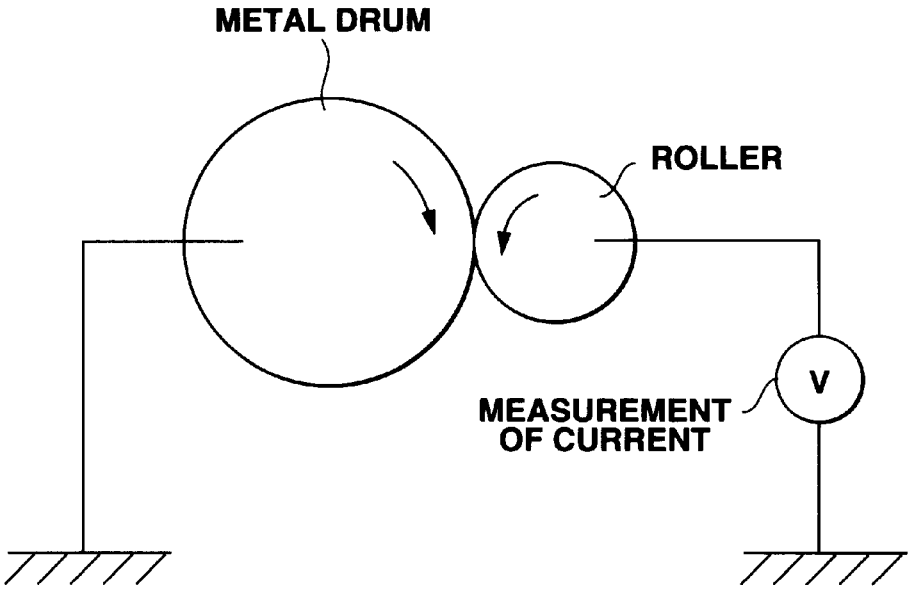
FIG. 5 is a schematic view showing a rotational resistance measuring meter used for Inventive Examples and Comparative Examples.

The electric resistance of each of the developing rollers (toner supports) was measured by using a rotational resistance-measuring meter shown in FIG. 5 in a state in which a voltage of 100 V was applied between the developing roller and a counter electrode (metal drum). The results are shown in Tables 1 and 2.

Figure 3:
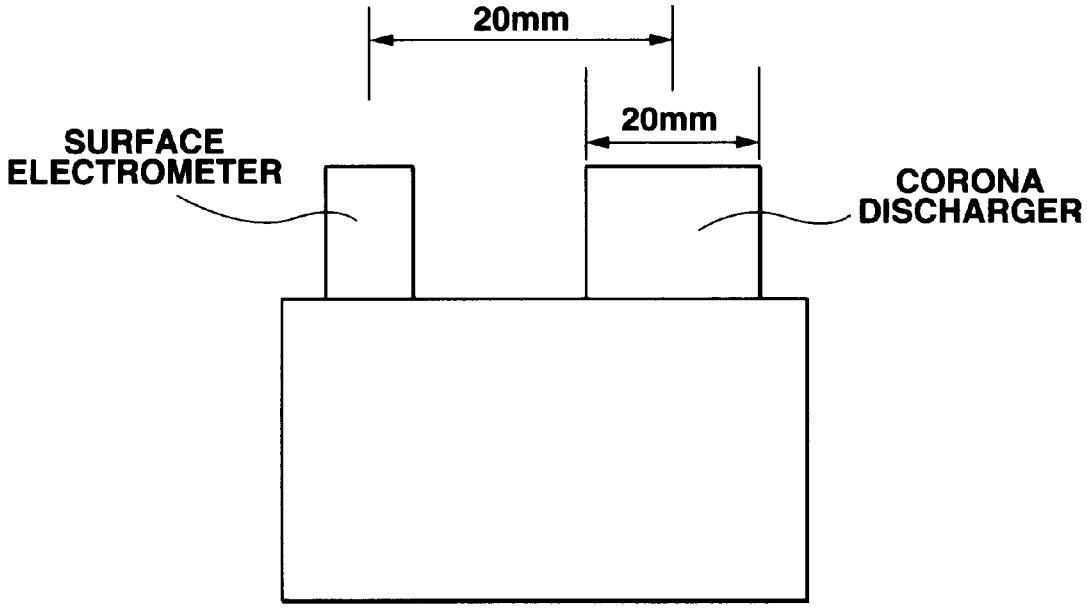
FIG. 3 is a schematic plan view showing the shape and dimension of a measuring unit used for Inventive Examples and Comparative Examples.

The surface potential of the developing roller was measured by using the measuring unit shown in FIG. 2 in a state in which a voltage of 8 kV was applied to the corona discharger 12 to charge the surface of the roller with corona discharge and the corona discharger 12 and the surface electrometer 13 were moved at a speed of 200 mm/sec. For each of the rollers in Inventive examples 1 to 3 and Comparative Example 1, the surface potential after an elapse of 0.35 sec since the surface of the roller was charged by corona discharge was measured; while for each of the rollers in Inventive Examples 4 and 5 and Comparative Examples 2 and 3, the potential until an elapse of 0.2 sec directly after the surface of the roller was charged by corona discharge was continuously measured. The shape and dimension of the measuring unit are the same as shown in FIG. 3. As the measurement environment, the temperature was adjusted at 22° C. and the humidity was adjusted at 50% RH.

For each of the rollers in Inventive Examples 1 to 3 and Comparative Example 1, the maximum value of the measured values over the entire surface of the roller was taken as a value of the surface potential, and further a difference between the maximum value and the minimum value of the measured values was also taken as a factor for evaluating the roller characteristics. The results are shown in Table 1. For each of the rollers in Inventive Examples 4 and 5 and Comparative Examples 1 and 2, the surface potential decay rate in a period from a time after an elapse of 0.1 sec since charging by corona discharge to a time after an elapse of 0.2 sec since charging by corona discharge was obtained. The results are shown in Table 2.

Next, each roller was mounted on the developing apparatus (image forming apparatus) shown in FIG. 4 as the developing roller 1, and was subjected to a development (image formation) test, and the image thus obtained was evaluated. The results are shown in Tables 1 and 2.

As is apparent from the results shown in Table 1, it is confirmed that each of the rollers in Inventive Examples 1 and 2, in which the electric resistance was optimized and also the surface charge retention ability was optimized on the basis of the maximum value of the surface potential after an elapse of 0.35 sec since the surface of the roller was charged by corona discharge, is capable of certainly forming a desirable image. It should be noted that the roller in Inventive Example 3 is capable of forming a substantially desirable image; however, it slightly causes uneven image density because of a large different between the maximum value and the minimum value of the measured values.

As is apparent from the results shown in Table 2, it is confirmed that each of the rollers in inventive examples 4 and 5, in which the surface potential decay rate until an elapse of 0.2 sec since the surface of the roller was charged by corona discharge was optimized at 0.1 V/sec or more, is capable of certainly forming a desirable image.

TABLE 1

| | | Inventive Example 1 | Inventive Example 2 | Comparative Example 1 | Inventive Example 3 |
|---|---|---|---|---|---|
| roller material | semi-conductive elastic layer | polyether-polyurethane | polyether-polyurethane | polyether-polyurethane | polyether-polyurethane |
| | resin-covering layer | alkyd/melamine | nylon (CM8000) | alkyd/melamine | alkyd/melamine |
| | resin mixing weight ratio | 7/3 | — | 7/3 | 7/3 |
| | conductive agent in covering layer | CB (printex 35)*1 | CB (printex 35)*1 | absence | ZnO (23K)*2 |
| | added amount of conductive agent *3 | 20 phr | 20 phr | absence | 25 phr |
| | volume resistivity of covering layer | $1 \times 10^{10}$ Ωcm | $1 \times 10^{10}$ Ωcm | $1 \times 10^{14}$ Ωcm | $1 \times 10^{12}$ Ωcm |
| | thickness of covering layer | 15 μm | 10 μm | 20 μm | 15 μm |
| characteristics of roller | resistance (when 100 V is applied) | $1.58 \times 10^{7}$ Ω | $5.51 \times 10^{8}$ Ω | $6.7 \times 10^{8}$ Ω | $1.95 \times 10^{7}$ Ω |
| | surface potential (maximum value) | 30 V | 20 V | 580 V | 80 V |
| | maximum value–minimum value | 5 V | 2 V | 25 V | 45 V |
| evaluation of image | black solid density | good | good | slightly thin | good |
| | fogging | good | good | slightly present | good |
| | uneven image | good | good | slightly uneven | slightly uneven |
| | ghost | good | good | occurrence | good |
| | others | | | failure considered to be due to discharge | |

*1carbon black "printex 35" produced by Degussa Japan Co., Ltd.
*2"23K" produced by Hakusui Chemical Industries, Ltd.
*3based on resin

TABLE 2

| | | Inventive Example 4 | Inventive Example 5 | Comparative Example 2 | Comparative Example 3 |
|---|---|---|---|---|---|
| roller material | semi-conductive elastic layer | polyether-polyurethane | polyether-polyurethane | polyether-polyurethane | polyether-polyurethane |
| | resin-covering layer | alkyd/melamine/silicone | alkyd/melamine/silicone | alkyd/melamine/silicone | alkyd/melamine/silicone |
| | resin mixing weight ratio | 7/2/1 | 7/2/1 | 7/2/1 | 7/2/1 |
| | conductive agent in covering layer | CB (printex 35)*1 | absence | absence | CB (printex 35)*1 |
| | added amount of conductive agent *2 | 27 phr | absence | absence | 10 phr |
| | thickness of covering layer | 15 μm | 5 μm | 15 μm | 15 μm |
| characteristics of roller | resistance (when 100 V is applied) | $2.3 \times 10^{6}$ Ω | $4.5 \times 10^{7}$ Ω | $4.6 \times 10^{8}$ Ω | $9.3 \times 10^{7}$ Ω |
| | surface potential decay rate | 0.19 V/sec | 0.28 V/sec | 0.04 V/sec | 0.08 V/sec |
| evaluation of image | black solid density | good | good | slightly thin | good |
| | fogging | good | good | slight amount of high potential fogging | good |
| | uneven image | good | good | slightly uneven | good |
| | ghost | good | good | occurrence | occurrence |
| | others | | | failure considered to be due to discharge | |

*1"printex 35" produced by Degussa Japan Co., Ltd.
*2based on resin

What is claimed is:

1. A toner support, which supports on its surface a non-magnetic one-component developer in the form of a thin layer, coming in contact with or in proximity to an image forming body, and supplies said developer onto the surface of said image forming body, thereby forming a visual image on said image forming body, said toner support comprising:

a shaft having a good conductivity; and a semi-conductive elastic layer formed around the outer periphery of said shaft;

wherein an electric resistance of said toner support when a voltage of 100 V is applied thereto is in a range of $10^4$ to $10^{10}$ Ω; and the maximum value of a surface potential of said toner support, which is measured after an elapse of 0.35 sec since the surface of said toner support is charged by generating a corona discharge by means of applying a voltage of 8 kV to a corona discharger disposed apart from the surface of said toner support by 1 mm, is in a range of 90 V or less.

2. A toner support according to claim 1, wherein a semi-conductive or insulating resin-covering layer is formed on the surface of said semi-conductive elastic layer.

3. A toner support according to claim 2, wherein said resin-covering layer is a semi-conductive resin-covering layer having a volume resistivity ranging from $10^3$ to $10^{12}$ Ωcm.

4. A toner support, which supports on its surface a non-magnetic one-component developer in the form of a thin layer, coming in contact with or in proximity to an image forming body, and supplies said developer onto the surface of said image forming body, thereby forming a visual image on said image forming body, said toner support comprising:

a shaft having a good conductivity; and a semi-conductive elastic layer formed around the outer periphery of said shaft;

wherein the absolute value of a surface potential decay rate of said toner support, which is measured at an elapse of 0.2 sec after charges are imparted on the surface of said toner support by generating a corona discharge by means of applying a voltage of 8 kV to a corona discharger disposed apart from the surface of said toner support by 1 mm, is in a range of 0.1 V/sec or more.

5. A toner support according to claim 4, wherein an electric resistance of said toner support when a voltage of 100 V is applied thereto is in a range of $10^4$ to $10^{10}$ Ω.

6. A toner support according to claim 4, wherein a semi-conductive or insulating resin-covering layer is formed on the surface of said semi-conductive elastic layer.

7. A toner support according to claim 6, wherein said resin-covering layer is a semi-conductive resin-covering layer having a volume resistivity ranging from $10^3$ to $10^{12}$ Ωcm.

8. An image forming apparatus comprising:

a toner support for supporting on its surface a non-magnetic one-component developer in the form of a thin layer, and carrying and supplying said developer on the surface of an image forming body;

said toner support comprising:

a shaft having a good conductivity; and a semi-conductive elastic layer formed around the outer periphery of said shaft;

wherein an electric resistance of said toner support when a voltage of 100 V is applied thereto is in a range of $10^4$ to $10^{10}$ Ω; and the maximum value of a surface potential of said toner support, which is measured after an elapse of 0.35 sec since the surface of said toner support is charged by generating a corona discharge by means of applying a voltage of 8 kV to a corona discharger disposed apart from the surface of said toner support by 1 mm, is in a range of 90 V or less.

9. An image forming apparatus according to claim 8, wherein said image forming body is a latent image retainer for retaining on its surface an electrostatic latent image; and said electrostatic latent image retained on the surface of said latent image retainer is visualized by allowing said non-magnetic one-component developer supported on the surface of said toner support to adhere on said electrostatic latent image.

10. An image forming apparatus comprising:

a toner support for supporting on its surface a non-magnetic one-component developer in the form of a thin layer, and carrying and supplying said developer on the surface of an image forming body;

said toner support comprising:

a shaft having a good conductivity; and a semi-conductive elastic layer formed around the outer periphery of said shaft;

wherein the absolute value of a surface potential decay rate of said toner support, which is measured at an elapse of 0.2 sec after charges are imparted on the surface of said toner support by generating a corona discharge by means of applying a voltage of 8 kV to a corona discharger disposed apart from the surface of said toner support by 1 mm, is in a range of 0.1 V/sec or more.

11. An image forming apparatus according to claim 10, wherein said image forming body is a latent image retainer for retaining on its surface an electrostatic latent image; and said electrostatic latent image retained on the surface of said latent image retainer is visualized by allowing said non-magnetic one-component developer supported on the surface of said toner support to adhere on said electrostatic latent image.

* * * * *